US007417377B2

(12) United States Patent
Born et al.

(10) Patent No.: US 7,417,377 B2
(45) Date of Patent: Aug. 26, 2008

(54) BLENDED LIGHT LAMP

(75) Inventors: Matthias Born, Geldern (DE); Rüdiger Jost, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 38 days.

(21) Appl. No.: 10/571,829

(22) PCT Filed: Sep. 7, 2004

(86) PCT No.: PCT/IB2004/051697

§ 371 (c)(1),
(2), (4) Date: Mar. 15, 2006

(87) PCT Pub. No.: WO2005/027588

PCT Pub. Date: Mar. 24, 2005

(65) Prior Publication Data

US 2007/0052367 A1 Mar. 8, 2007

(30) Foreign Application Priority Data

Sep. 18, 2003 (EP) ..... 03103440

(51) Int. Cl.
*H01J 13/46* (2006.01)
*H01J 1/62* (2006.01)

(52) U.S. Cl. ..... 315/51; 315/209 M; 315/312; 313/571

(58) Field of Classification Search ..... 315/51, 315/56, 200 R, 201, 209 M, 209 CD, 291, 315/312; 313/571, 578, 637, 639
See application file for complete search history.

(56) References Cited

U.S. PATENT DOCUMENTS

| | | | | |
|---|---|---|---|---|
| 4,319,157 | A * | 3/1982 | De Vrijer | 313/642 |
| 4,350,930 | A * | 9/1982 | Peil et al. | 315/49 |
| 4,725,467 | A * | 2/1988 | Groh et al. | 428/34.4 |
| 5,994,847 | A * | 11/1999 | Konopka | 315/209 R |
| 6,107,756 | A * | 8/2000 | Parra | 315/324 |
| 6,400,087 | B2 * | 6/2002 | van den Nieuwenhuizen et al. | 315/73 |
| 6,674,239 | B1 * | 1/2004 | Westemeyer et al. | 313/594 |
| 6,806,649 | B2 * | 10/2004 | Mollema et al. | 315/96 |
| 2003/0006705 | A1 * | 1/2003 | Alderman et al. | 313/607 |
| 2003/0025455 | A1 * | 2/2003 | Alderman et al. | 313/634 |
| 2005/0042967 | A1 * | 2/2005 | Jackson et al. | 445/26 |
| 2005/0073256 | A1 * | 4/2005 | Jackson et al. | 313/634 |

FOREIGN PATENT DOCUMENTS

DE 32 24575 A1 2/1983

* cited by examiner

*Primary Examiner*—Thuy Vinh Tran
*Assistant Examiner*—Tung X Le

(57) ABSTRACT

The invention relates to a blended light lamp (1) having an incandescent lamp (2) and a gas discharge lamp (3), a rectifier (4), an energy storage means (5) and an ignition device (6). The high-pressure discharge has an operating voltage of 180 V, which can be achieved by filling a discharge vessel of the gas discharge lamp (3) with, in particular, an amount of mercury of 153 micromole/cm$^3$. In this way a high total luminous flux can be obtained in the operating state.

10 Claims, 1 Drawing Sheet

BLENDED LIGHT LAMP

Figure 1:
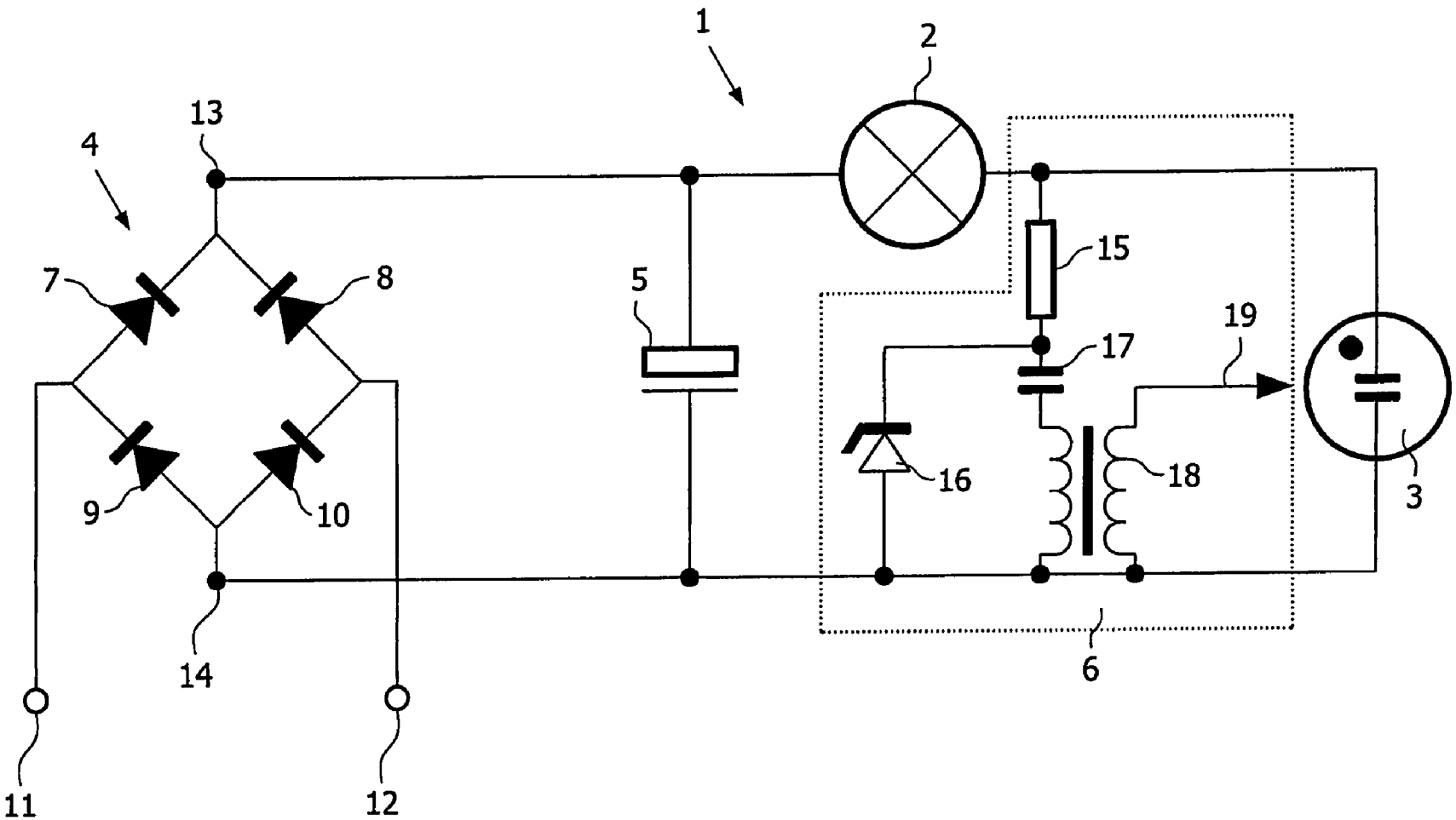

The invention relates to a blended light lamp comprising an incandescent lamp and a gas discharge lamp, a rectifier, an energy storage means, and an ignition device.

A simple way of ballasting high-pressure discharge lamps takes the form of the blended light lamp or unitary light source. In this case a tungsten wire, which also acts as an incandescent filament, is connected in series with a high intensity discharge (HID) lamp. A blended light lamp of this kind is known from DE 32 24 575 A1. To start the HID lamp and to keep it operating, there is a considerable amount of electrical circuitry that has to be operated. Also, the life of the HID lamp is very short, which in the end results in the blended light lamp failing.

It is therefore an object of the invention to design a gas discharge lamp such that it can be operated with a simple circuit, and to specify a gas discharge lamp whose expected life is high. Also, the total luminous flux is to be high.

This object is achieved by virtue of the features of claim 1. In accordance with the invention, the gas discharge lamp is filled with 80-230 micromole/$cm^3$ of mercury, advantageously with 180-230 micromole/$cm^3$ of mercury, and particularly with 153 micromole/$cm^3$ of mercury. In view of possible fluctuations in the line voltage, the operating voltage selected for the high-pressure discharge is chosen to be 180 V, which is achievable by filling the arc tube volume of a gas discharge lamp with a quantity of mercury of, in particular, 153 micromole/$cm^3$.

The volume of a discharge vessel, which vessel is also referred to below as an envelope or arc tube, having an inside diameter of 4.4 mm and an inside length of 12 mm, works out as V=182 $mm^3$. Taking a cold filling pressure as a basis, the filling comprises: 5.6 mg of Hg, 6.3 mg of NaI, 1.2 mg of TlI, 2.5 mg of $DyI_3$ and 400 mbar of Ar. As quantities per unit volume of the filling, this gives the following amounts:

Hg: 153 micromole/$cm^3$
NaI: 231 micromole/$cm^3$
TlI: 20 micromole/$cm^3$
$DyI_3$: 25 micromole/$cm^3$
Ar: 15.9 micromole/$cm^3$.

This, however, is only one of many possible fillings: in place of $DyI_3$, other light producers known in the lighting industry may also be used, such as the rare-earth halides $HoI_3$, $TmI_3$, $CeI_3$ and so on. The quantities are then likewise approximately 25 micromole/$cm^3$. As well as these there are also the class of so-called 3-line light producers: NaI, TlI, InI and also so-called molecular light producers such as NaI/$SnI_2$ mixtures. The principle of the invention is equally applicable to all these lamp fillings. The limits for the quantities contained in the filling are around ±50% and in this way the relevant range of lamp parameters is covered.

The lamps can be ignited by conventional antenna ignition, because a peak voltage of around 311 volts is present across the capacitor as a peak-value voltage.

One advantage is that the lamp system lights immediately when switched on. In the switching-on process, the voltage drop across the high-pressure gas discharge is an rms voltage of approximately 20 V, which represents the entire drop across the electrodes. The difference from the line voltage, which difference is equal to 200 V, is thus applied to the incandescent filament. A current of 0.7 A thus flows, depending on the resistance of the incandescent filament at this voltage. The power which is drawn at the incandescent filament is thus 140 W, which corresponds to a luminous flux of approximately 1700 lumens, while the luminous flux from the gas discharge at this time is so small that it can be ignored.

Due to the starting power of 14 W fed into the high-pressure gas discharge, the wall temperature of the arc tube rises with time, which causes greater evaporation of the mercury, whereby the burning voltage of the high-pressure gas discharge increases. This brings down the voltage across the incandescent filament and, at the same time, the lamp current, because the characteristic of the incandescent filament is positive. The current drop is such that the overall power fed into the high-pressure lamp rises. This process finally causes the system to settle at a steady operating point at which no further rise is possible in the voltage across the high-pressure lamp, because all the mercury has been completely evaporated. The final current is then 0.4 A and the power drawn by the high-pressure lamp is thus 72 W, whereas at the incandescent lamp it is only 16 W. Hence the total power is 88 W. In continuous operation, the luminous flux from the high-pressure gas discharge is 6480 lumens and that from the incandescent filament only 192 lumens, the total luminous flux thus being 6672 lumens. This corresponds to an overall luminous efficacy of 6672 lm/88 W=76 lm/W. Between the switch-on state of the system and its final state, the luminous flux thus rises from 1700 to 6672 lumens over a period of approximately 2 minutes.

The lamp system is not based on a pure mercury high-pressure gas discharge in quartz, but instead aluminum oxide ceramic is advantageously used as the arc tube material. Aluminum oxide ceramic is also referred to as a sintered ceramic material or densely sintered aluminum oxide or as polycrystalline alumina (abbreviation PCA) and its chemical formula is $Al_2O_3$. In contrast to arc tubes of quartz, metal halide salts, which produce a considerable improvement both in the color properties of the high-pressure lamp and in its efficacy, can then be added. A constant burning voltage throughout lamp life is possible in the case of the PCA arc tube, but not in the case of the quartz lamp because, in the course of time, halogens such as iodine diffuse through the wall of the arc tube of the quartz lamp and the result is an increase in the burning voltage. With PCA arc tubes, on the other hand, this diffusion phenomenon does not occur.

These and other aspects of the invention are apparent from and will be elucidated with reference to the embodiments described hereinafter.

IN THE DRAWINGS

FIG. 1 is a circuit diagram of a blended light lamp.

FIG. 1 shows a blended light lamp 1 having an incandescent lamp 2, a gas discharge lamp 3, a rectifier 4, an energy storage means 5 and an ignition device 6. The rectifier 4 has four diodes 7-10 and its input end can be connected by terminals 11 and 12 to a source of a.c. line voltage. The capacitor 5 that acts as the energy storage means is connected to outputs 13 and 14 on the secondary side of the rectifier 4. The incandescent lamp 2 and the gas discharge lamp 3 are connected in series and to the outputs 13, 14 of the rectifier 4, i.e. in parallel with the capacitor 5. A second series circuit comprising the incandescent lamp 2 and the ignition device 6 is also connected to the outputs 13, 14. The ignition device 6 comprises a limiting resistor 15, a Zener diode 16, a capacitor 17, and a coil 18 having an antenna 19.

On the primary side, the rectifier 4 is connected directly to the 220 V line voltage. On the secondary side there is the 22 uF capacitor 5, in parallel with which an incandescent filament of a halogen lamp 2 is connected in series with the high-pressure gas discharge lamp 3. The high-pressure gas discharge lamp 3 comprises an aluminum oxide arc tube having an inside diameter of 4.4 mm, a wall thickness of 0.8 mm and an internal length of 12 mm. An end dimension is 2.0 mm, and arranged against this end are end-pieces which enclose the electrodes and measure 14 mm in length. The arc tube filling comprises 5.6 mg of mercury and 10 mg of a mixture of $NaI/TlI/DyI_3$. The arc tube is situated in the evacuated outer envelope.

LIST OF REFERENCE NUMERALS

1 Blended light lamp
2 Incandescent lamp
3 Gas discharge lamp
4 Rectifier
5 Capacitor/energy storage means
6 Ignition device
7 Diode
8 Diode
9 Diode
10 Diode
11 Terminal
12 Terminal
13 Output
14 Output
15 Limiting resistor
16 Zener diode
17 Capacitor
18 Coil
19 Antenna

The invention claimed is:

1. A blended light lamp (1) comprising an incandescent lamp (2) and a gas discharge lamp (3), a rectifier (4), an energy storage means (5) and an antenna ignition device (6), characterized in that the gas discharge lamp (3) has a mercury filling of between 76 and 230 micromole/$cm^3$ and in that the gas discharge lamp (3) has a discharge vessel that comprises an aluminum oxide ceramic and in that, in the operating state, a voltage of between 55% and 95% of the total voltage that is applied across the incandescent lamp in series with the gas discharge lamp is applied to the gas discharge lamp (3).

2. A blended light lamp as claimed in claim 1, characterized in that the gas discharge lamp (3) has a mercury filling of between 133 and 173 micromole/$cm^3$.

3. A blended light lamp as claimed in claim 2, characterized in that the gas discharge lamp (3) has a mercury filling of 153 micromole/$cm^3$.

4. A blended light lamp as claimed in claim 1, characterized in that the gas discharge lamp (3) has a filling comprising a mixture of sodium iodide and a rare-earth halide.

5. A blended light lamp as claimed in claim 1, characterized in that the gas discharge lamp (3) has a filling comprising TlI.

6. The blended light lamp as claimed in claim 1, wherein the voltage applied to the gas discharge lamp further comprises between 60% and 90% of the total voltage that is applied across the incandescent lamp in series with the gas discharge lamp.

7. The blended light lamp as claimed in claim 6, wherein the voltage applied to the gas discharge lamp still further comprises 82% of the total voltage that is applied across the incandescent lamp in series with the gas discharge lamp.

8. A blended light lamp (1) comprising an incandescent lamp (2) and a gas discharge lamp (3), a rectifier (4), an energy storage means (5) and an antenna ignition device (6), characterized in that the gas discharge lamp (3) has a mercury filling of between 76 and 230 micromole/$cm^3$ and in that the gas discharge lamp (3) has a discharge vessel that comprises an aluminum oxide ceramic and in that, in the operating state, a voltage of between 55% and 95% of the total voltage that is applied across the incandescent lamp in series with the gas discharge lamp comprises between 160 V and 200 V applied to the gas discharge lamp (3).

9. The blended light lamp as claimed in claim 8, wherein in the operating state, the voltage applied to the gas discharge lamp further comprises between 170 V and 190 V.

10. The blended light lamp as claimed in claim 9, wherein in the operating state, the voltage applied to the gas discharge lamp further comprises 180 V.

* * * * *